US010119792B2

(12) United States Patent
Howland

(10) Patent No.: US 10,119,792 B2
(45) Date of Patent: Nov. 6, 2018

(54) MULTI-LAYER, MULTI-ELEMENT BODY ARMOR PANEL WITH IMPROVED COMPRESSIBILITY

(71) Applicant: Warwick Mills Inc., New Ipswich, NH (US)

(72) Inventor: Charles A. Howland, Temple, NH (US)

(73) Assignee: Warwick Mills Inc., New Ipswich, NH (US)

( * ) Notice: Subject to any disclaimer, the term of this patent is extended or adjusted under 35 U.S.C. 154(b) by 261 days.

(21) Appl. No.: 14/820,828

(22) Filed: Aug. 7, 2015

(65) Prior Publication Data

US 2016/0040963 A1 Feb. 11, 2016

Related U.S. Application Data

(60) Provisional application No. 62/035,071, filed on Aug. 8, 2014.

(51) Int. Cl.
*F41H 5/04* (2006.01)

(52) U.S. Cl.
CPC ..... *F41H 5/0471* (2013.01); *F41H 5/0457* (2013.01); *F41H 5/0492* (2013.01)

(58) Field of Classification Search
CPC ..... F41H 5/04
See application file for complete search history.

(56) References Cited

U.S. PATENT DOCUMENTS 4,316,286 A * 2/1982 Klein ..... F41H 1/02 109/49.5
4,810,559 A 3/1989 Fortier
5,316,820 A * 5/1994 Harpell ..... B32B 3/16 428/102

(Continued)

FOREIGN PATENT DOCUMENTS

EP 611943 A1 8/1994
WO 200031494 A1 6/2000

OTHER PUBLICATIONS

International Search Report of PCT Appl No. PCT/US2015/044157 filed Aug. 7, 2015, dated Jun. 7, 2016.

(Continued)

*Primary Examiner* — Andrew T Piziali
(74) *Attorney, Agent, or Firm* — Maine Cernota & Rardin

(57) ABSTRACT

An MFA panel provides enhanced compressibility and off-axis threat protection by distributing solid elements among a plurality of vertically stacked, flexible supporting sheets, so that the elements on each sheet are spaced apart while the stacked arrangement provides adjacent or overlapping coverage of the panel, while allowing the solid elements to slide over each other during compression. The solid elements can be triangular or square, and can be metal or ceramic. The supporting sheets can be high tensile, such as para aramid, or low tensile, such as PET, Nylon, or cotton, for enhanced compressibility, flexibility, drape, and hand. A high tensile backing ply can be included to inhibit tensile failure of low tensile supporting sheets. In embodiments, the panels are attached to each other only at their edges. Fibers of para aramid supporting sheets can be unidirectional, so as to share the load of an impact throughout the panel.

21 Claims, 10 Drawing Sheets

(56) References Cited

U.S. PATENT DOCUMENTS

| | | | | |
|---|---|---|---|---|
| 5,514,241 | A | 5/1996 | Gould et al. | |
| 5,601,895 | A | 2/1997 | Cunningham | |
| 7,241,709 | B2 * | 7/2007 | Chiou ..... | A41D 31/0061 2/2.5 |
| 8,245,319 | B2 | 8/2012 | Neal | |
| 2008/0087161 | A1 | 4/2008 | Dean et al. | |
| 2008/0119099 | A1 | 5/2008 | Palley | |
| 2011/0296979 | A1 | 12/2011 | Howland | |
| 2012/0159680 | A1 | 6/2012 | Howland | |

OTHER PUBLICATIONS

Written Opinion of PCT Appl No. PCT/US2015/044157 filed Aug. 7, 2015, dated Jun. 7, 2016.

International Preliminary Report on Patentability of PCT Application No. PCT/US2015/044157 filed Aug. 7, 2015, dated Feb. 14, 2017.

International Search Report and Written Opinion of International Application No. PCT/US2016/058113, dated Jul. 21, 2107, 14 pages.

* cited by examiner

MULTI-LAYER, MULTI-ELEMENT BODY ARMOR PANEL WITH IMPROVED COMPRESSIBILITY

RELATED APPLICATIONS

This application claims the benefit of U.S. Provisional Application No. 62/035,071, filed Aug. 8, 2014, which is herein incorporated by reference in its entirety for all purposes.

FIELD OF THE INVENTION

The invention relates to wearable body armor, and more particularly, to flexible, knife and stab protective wearable body armor.

BACKGROUND OF THE INVENTION

Service personnel who are involved in various dangerous occupations, including corrections, confinement, law enforcement, and intelligence operations, as well as soldiers and other members of the U.S. Armed Forces, would often benefit from using body armor. The missions of these service personnel expose them to a variety of threats, including knives, blades, spikes, and other improvised weaponry. Small arms (handguns and small-caliber weapons) can also be a concern in some circumstances. However, the armor used to protect against these threats is often bulky and uncomfortable for all-day wear.

An armor panel that can be worn for long periods of time requires a soft, flexible, lightweight material with good hand and drape. Another important factor that affects comfort is planar compressibility (referred to herein generally as "compressibility"), which is the ability of a nominally planar garment panel to be foreshortened or "compressed" within its plane, so that it occupies a smaller planar area. Normal garments are compressible, and do not significantly restrict motion as a wearer bends, sits, twists and goes about other daily activities. However, an incompressible armor panel tends to restrict motions that must be accommodated by a reduction of the distance between the belt line and the neck line of any garments being worn. Such motions include bending and sitting movements that require foreshortening of the front torso length as a wearer transitions from one position to another. Accordingly, compressible armor panels would be much more comfortable for users than the relatively incompressible solutions that are generally available.

One approach, primarily intended for protection against knife, blade, spike, and similar threats, is to provide an array of solid protective elements supported in an adjoining configuration by a flexible supporting sheet made from a high-performance textile, thereby providing the protection of a steel plate but with the flexibility of a textile. This technology is generally referred to as "Metal Flex Armor" or "MFA," although the term MFA as used herein also includes designs that are based on non-metallic rigid solid elements. MFA is widely used, and is a major presence in the stab protection market. When ballistic protection is required, MFA panels are sometimes used in combination with ballistic panels, for example by providing a fabric carrier having separate sleeves or pockets for supporting the MFA and ballistic panels.

MFA technology is generally based on small solid elements which fit together in an array. FIG. 1A illustrates manufacture of an MFA panel 100 using triangular solid elements 102 arranged in a hexagonal pattern, while FIG. 1B illustrates a protective vest 104 manufactured using the panel 100 of FIG. 1A. FIG. 2A illustrates a spike threat 200 impinging on an MFA array 100 of triangular solid elements, and FIG. 2B illustrates a blade threat 202 impinging on an MFA array of triangular solid elements 100.

In many existing MFA designs, the supporting sheets are made from para-aramid, which offers good flame resistance, durability, and Berry compliance, but lacks in drape and hand.

As noted above, an MFA panel can provide the protection of a steel plate with flexibility that approximates a textile. However, existing MFA designs have very low compressibility, due to the closely spaced placement of the solid elements on the supporting sheet, and therefore can be uncomfortable for all-day wear.

What is needed, therefore, is a knife/blade/spike protective MFA panel that provides the protection of a steel plate with flexibility approximating a textile, while also providing high compressibility as compared to currently available MFA designs.

SUMMARY OF THE INVENTION

The knife/blade/spike protective MFA panel of the present invention provides the protection of a steel plate with flexibility approximating a textile, while also providing high compressibility as compared to currently available MFA designs. In the disclosed MFA panel, the solid elements are distributed among a plurality of flexible textile supporting sheets that are vertically stacked. The solid elements are spaced apart on the individual supporting sheets, but they are arranged relative to each other such that they present a protective profile to threats that is virtually identical with or superior to existing MFA designs.

Because of the gaps between the solid elements on the individual supporting sheets, the solid elements are able to slide over each other within the plane, thereby avoiding the limitations on compressibility that are inherent to the close packed arrays of existing MFA designs, and allowing the combined MFA panels of the present invention to be compressed in the plane of the solid elements. In embodiments, the percentage of the total area of each individual textile supporting sheet that is not covered with solid elements is significant. As an example, for an embodiment for which the solid elements are evenly distributed among six supporting sheets, the open textile area for each of the supporting sheets (i.e. the fraction of each supporting sheet that is not directly attached to solid elements) is five sixths, and this open textile area can be compressed.

The comfort benefit of compressibility in the armor panels of the present invention is very significant for users, because it allows the panels to accommodate motions of a wearer such as bending, sitting, and twisting that change the torso length, and therefore require variation of the distance between the belt line and the neck line of armor panels worn on the torso. Similar benefits apply to panels worn on other regions of a user's body.

In embodiments, horizontally adjacent triangular or square solid elements are distributed vertically among multiple supporting sheets made of para-aramid material. In some embodiments, the supporting sheets are attached to each other only at their edges, which allows the inner supporting sheets of the panel to have a complete range of relative motion when compressed or flexed.

High strength, high hardness, density, and energy to failure or toughness are all considered when selecting the material for the solid elements. Embodiments of the present invention include solid elements manufactured from steel, stainless steel, titanium, aluminum, and other alloys, as well as ceramics. In some embodiment the solid elements are large, for example greater than 50 mm on a side, while in other embodiments they are less than 25 mm on a side. The choice of solid element size primary involves a tradeoff between compressibility, which is favored by smaller solid elements, and cost and mass reduction, which are favored by larger solid elements.

The flexible supporting sheets in various embodiments include para-aramid fibers nylon, PET and other blends. Embodiments provide flame resistance and/or Berry compliance, while other embodiments provide higher compressibility and lower cost. Armor manufactured using panels of the present invention can be concealable or overt.

In some embodiments, the horizontally adjacent solid elements are vertically separated by more than 1 layer, thereby increasing the panel thickness but increasing the threat resistance and flexibility. Various embodiments include steel in the solid elements to reduce the panel thickness.

The present invention is a flexible and compressible armor panel that is suitable for constructing wearable multi-threat protection. The panel includes a plurality of flexible fabric supporting sheets arranged in a vertical stack to form a panel, and a plurality of solid elements distributed among and adhered to the supporting sheets, said solid elements being horizontally spaced apart on the individual supporting sheets, but arranged in the stack in a vertically offset but horizontally adjacent or overlapping relationship that covers substantially all of a protective region of the panel, said solid elements being slidable over each other so as to allow compression of the panel.

In embodiments, the supporting sheets are attached to one another only about their edges, thereby allowing portions of the supporting sheets to move horizontally relative to each other.

In any of the preceding embodiments, the solid elements can include metal. And in some of these embodiments, the metal can be steel.

In any of the preceding embodiments, at least one of the supporting sheets can include para-aramid fibers. And in some of these embodiments, the para-aramid fibers staple fibers.

In any of the preceding embodiments, at least one of the supporting sheets can include a yarn having an average tenacity of less than 10 gpd. And in some of these embodiments, the supporting sheet is a woven fabric sheet.

In any of the preceding embodiments, the solid elements can be triangular, and can be arranged when overlaid in a horizontally adjacent, hexagonal configuration. And in some of these embodiments the solid elements are distributed in pairs among three of the supporting sheets, the pairs being directly opposed to each other and touching at only one central vertex.

In any of the preceding embodiments except the previous one, the solid elements can be square, and can be arranged when overlaid in a square, horizontally overlapping configuration.

In any of the preceding embodiments, at least some pairs of horizontally adjacent or overlapping solid elements can be vertically separated from each other by more than one layer of the stack of supporting sheets.

In any of the preceding embodiments, the solid elements adhered to at least one of the individual supporting sheets can be horizontally spaced apart from each other by a distance that is at least 10% of a smallest side dimension of the solid elements.

In any of the preceding embodiments, the armor panel can provide protection against specified maximum ballistic, blade, and spike threats.

In any of the preceding embodiments, the armor panel can be compressed by an amount equal to at least 25% of its effective width when tested by means of a vertical armor compression test.

Any of the preceding embodiments can further include adhesive applied around and over edges of the solid elements attached to at least one of the supporting sheets, said adhesive creating a feathered elastomeric transition from a top of the solid element to an uncoated surface of the supporting sheet.

In any of the preceding embodiments, the supporting sheets can contain yarn of tenacity of less than 10 g/denier.

In any of the preceding embodiments, the supporting sheets can include at least one of nylon, polyester, PET, and cotton.

Any of the preceding embodiments can further include a para aramid backer ply applied to a rear surface of the stack of the panel. And in some of these embodiments the para aramid backer ply is made from yarn with tenacity greater than 10 gpd and denier per inch greater than 15,000.

In any of the preceding embodiments, the solid elements can be attached to the supporting sheets by an adhesive. In some of these embodiments, the adhesive provides a bond of approximately 100 lbf per inch of lap shear strength. And in other of these embodiments, the adhesive is one of a sulfur cure chloroprene elastomer and a thermoplastic polyether urethane.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1A:
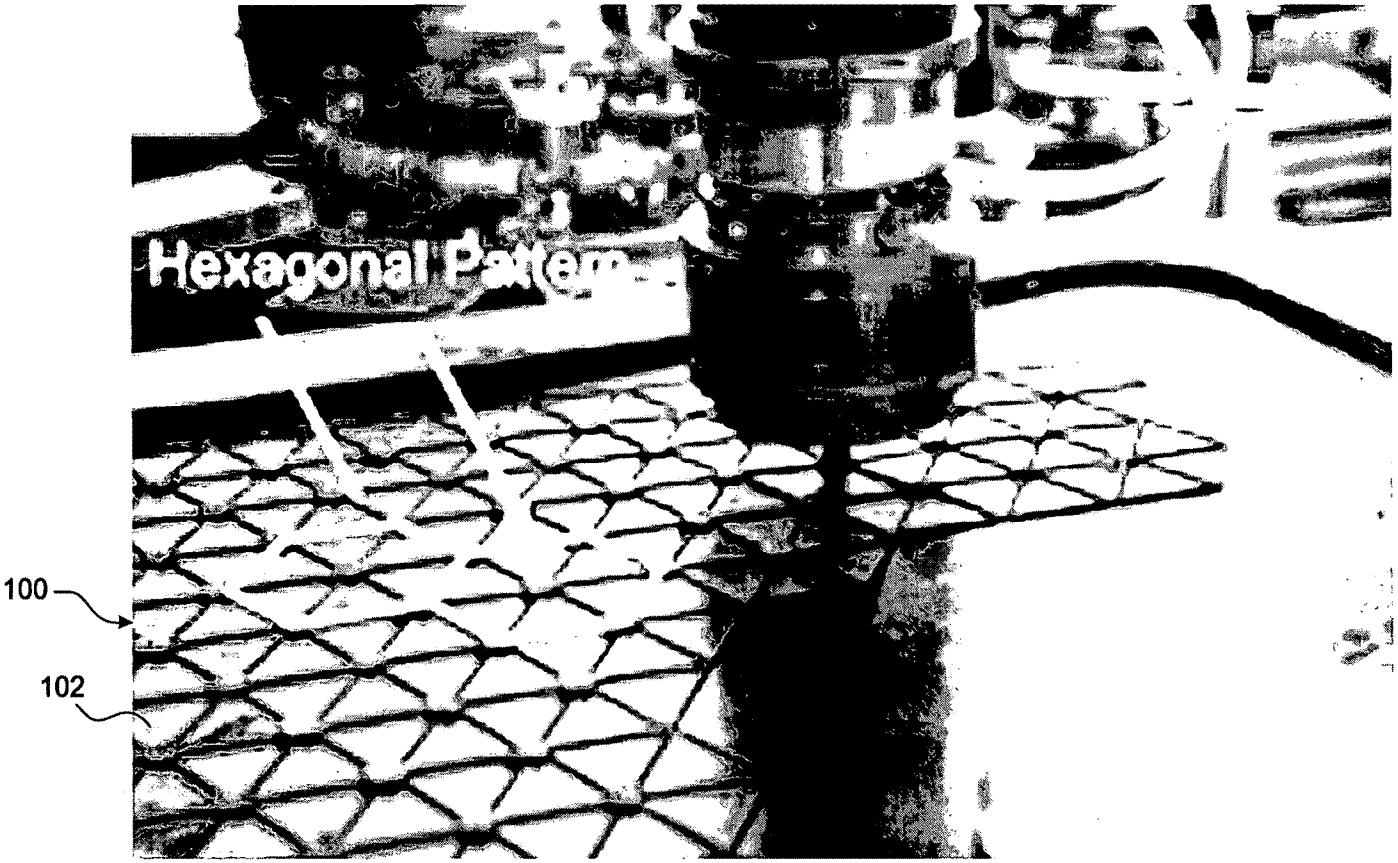
Figure 1A Prior Art
FIG. 1A is a perspective view of an MFA panel of the prior art, shown during manufacture.
Figure 1B:
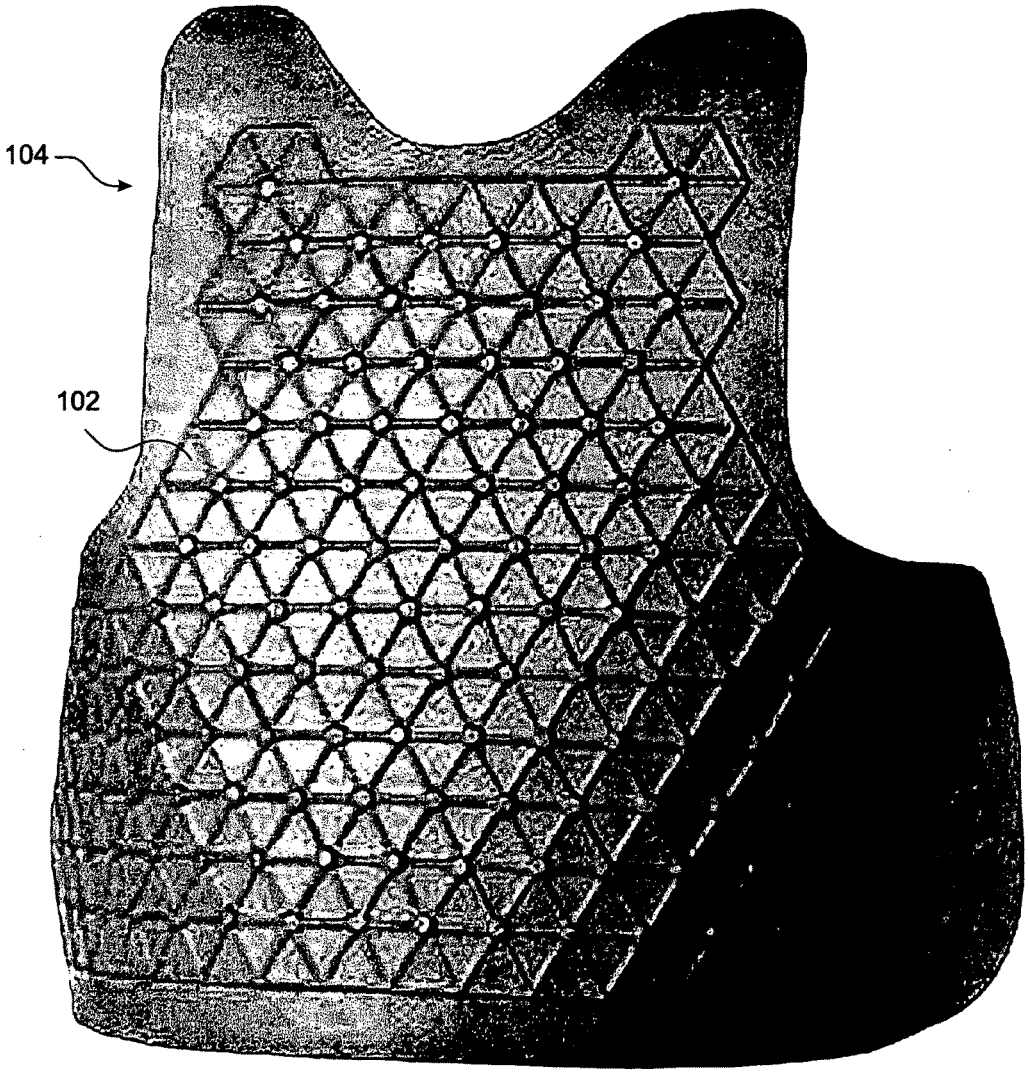
Figure 1B Prior Art
FIG. 1B is a perspective view of a protective vest manufactured using the panel of FIG. 1A.
Figure 2B:
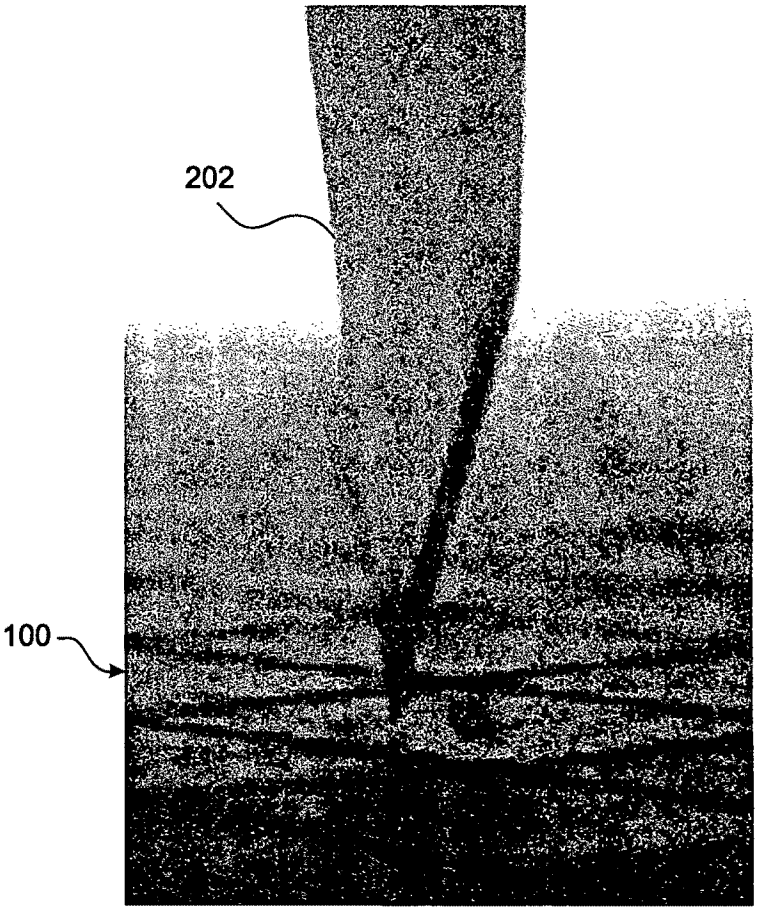
Figure 2B Prior Art
FIGS. 2A and 2B illustrate spike and blade threats, respectively, applied to the prior art MFA panel of FIG. 1A.
Figure 2A:
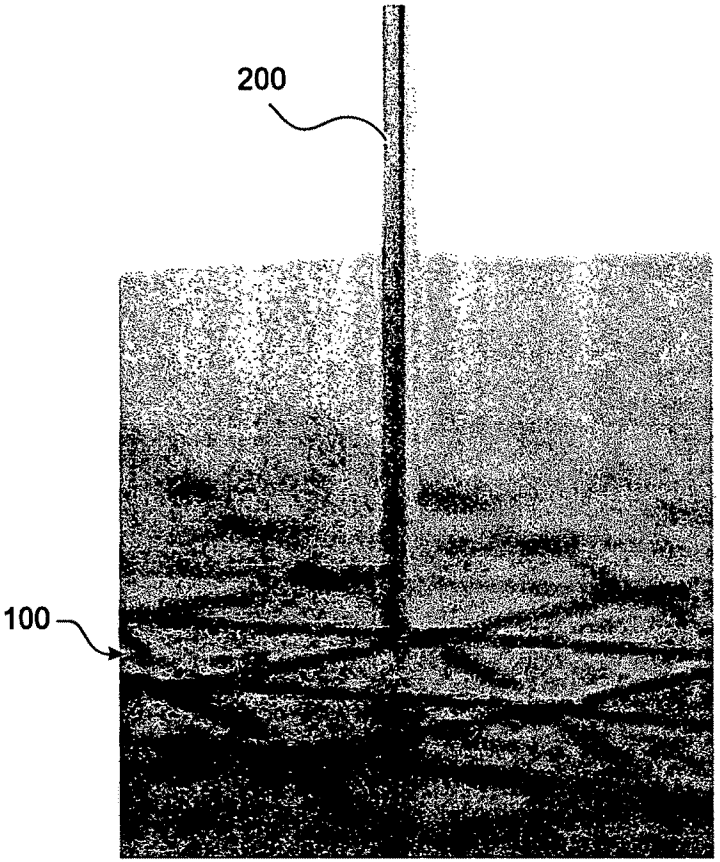
Figure 2A Prior Art
Figure 3B:
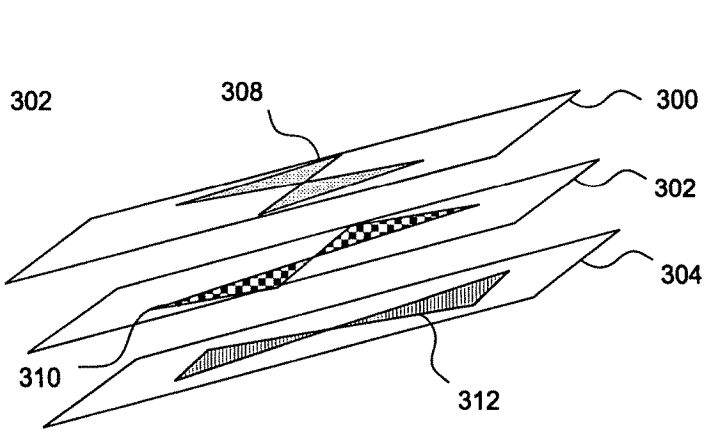
FIGS. 3A through 3C are perspective views of a three-layer embodiment in which each layer includes a pair of opposing triangular solid elements.
Figure 3A:
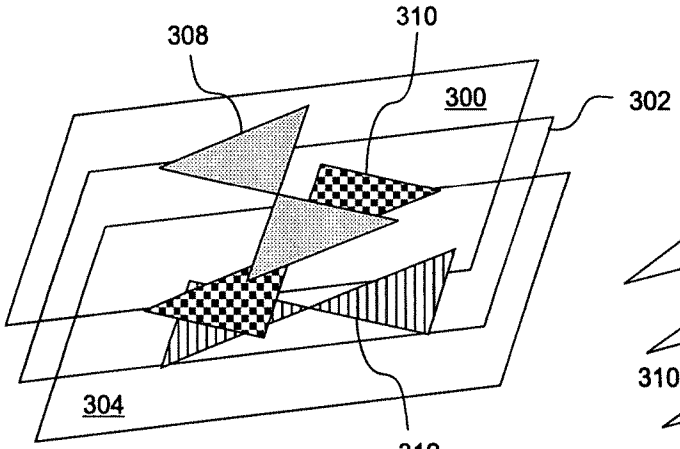
Figure 3D:
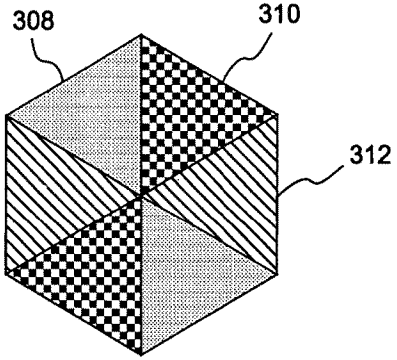
FIG. 3D is a front view of the assembled panel of FIGS. 3A through 3C showing the three overlaid pairs of triangular solid elements arranged in a closely spaced hexagonal arrangement.
Figure 3C:
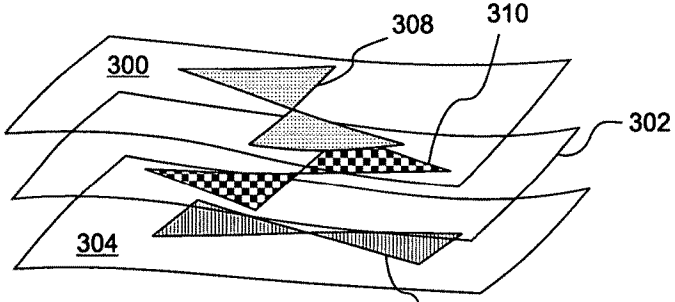

The MFA panel of the present invention provides protection against knife, stab, and other non-ballistic threats that is at least comparable to currently available MFA panels while also providing improved compressibility and user comfort. With reference to FIGS. 3A through 3C, the solid elements 308, 310, 312 in the MFA panel of the present invention are distributed among a plurality of flexible textile supporting sheets 300, 302, 304 that are stacked vertically. In FIGS. 3A through 3C the supporting sheets 300, 302, 304 have been separated for clarity of illustration.

In this embodiment, each sheet 300, 302, 304 includes a pair of triangular solid elements 308, 310, 312 arranged in symmetrically opposed positions, with only their closest vertices touching. Successive layers are oriented such that each pair of solid elements 308, 310, 312 is rotated by 60 degrees as compared to the layer above. As a result, when the three layers are combined to form a single panel, the pairs of solid elements 308, 310, 312 are superimposed to present a closely spaced hexagonal pattern to threats, as shown in FIG. 3D. The combined layers of solid elements 308, 310, 312 thereby present a protective profile to threats that is virtually identical with existing MFA designs that arrange all of the solid elements on a single supporting sheet. However, unlike MFA designs of the prior art, the embodiment of FIGS. 3A-3D allows the solid elements to slide over each other when the user bends or twists, thereby providing greatly enhanced compressibility and a greater degree of comfort to the wearer as compared to existing MFA designs.

The solid elements 308, 310, 312 in the embodiment of FIGS. 3A-3D are horizontally "adjacent," as can be seen in FIG. 3D. Other embodiments, such as the embodiment of FIGS. 4A-4D, take advantage of the vertical offsets of the supporting sheets to partially overlap the solid elements, thereby improving protection against angled knife and spike attacks.

Figure 4A:
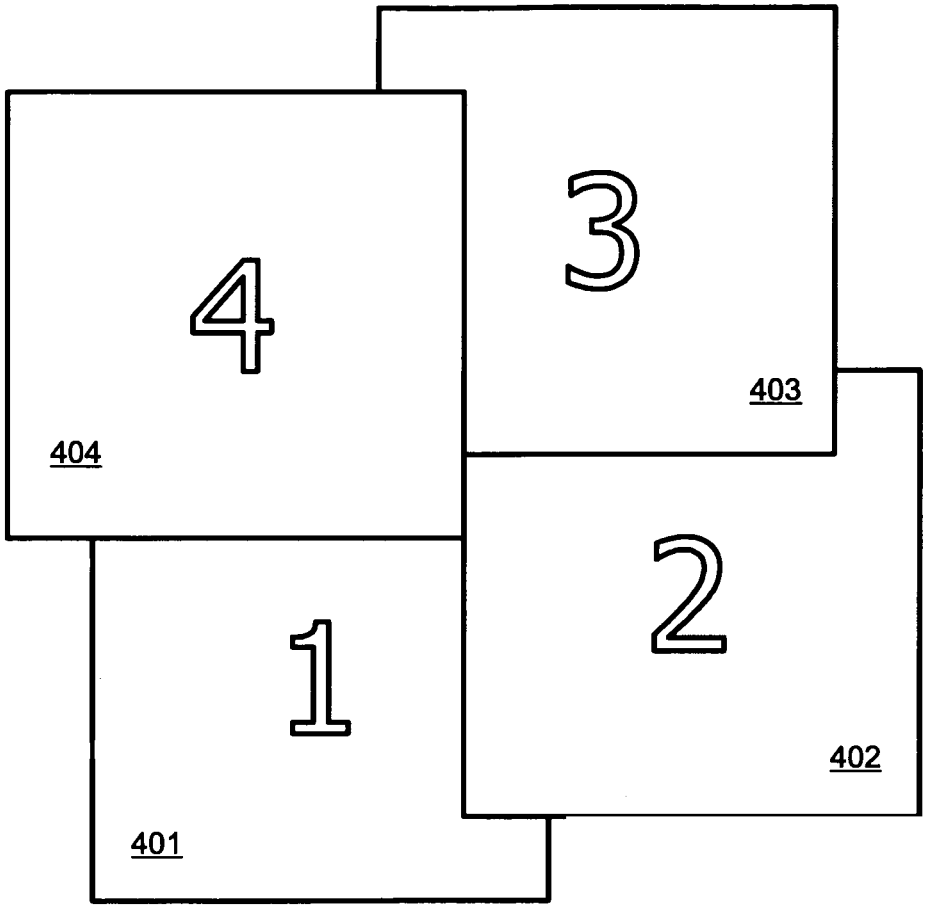
FIGS. 4A and 4B are front and perspective views, respectively, of an arrangement of four square, partially overlapping solid elements.
Figure 4B:
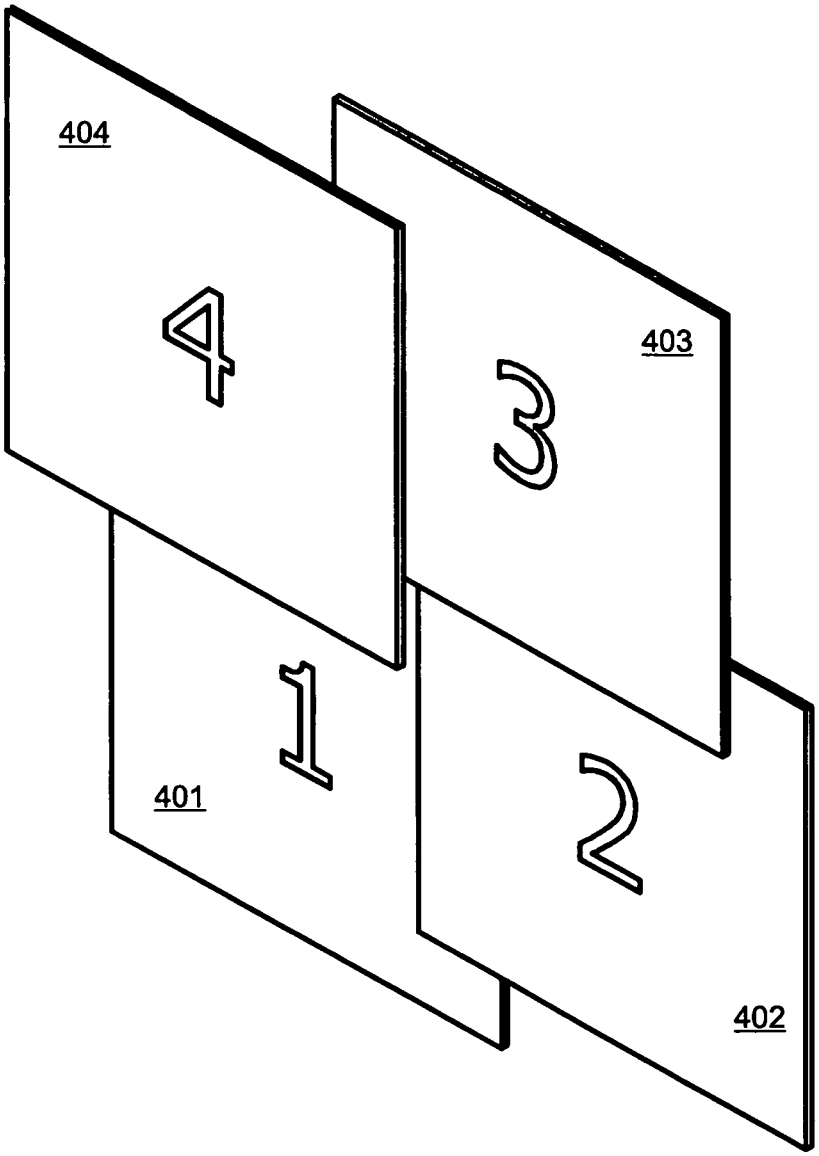
Figure 4C:
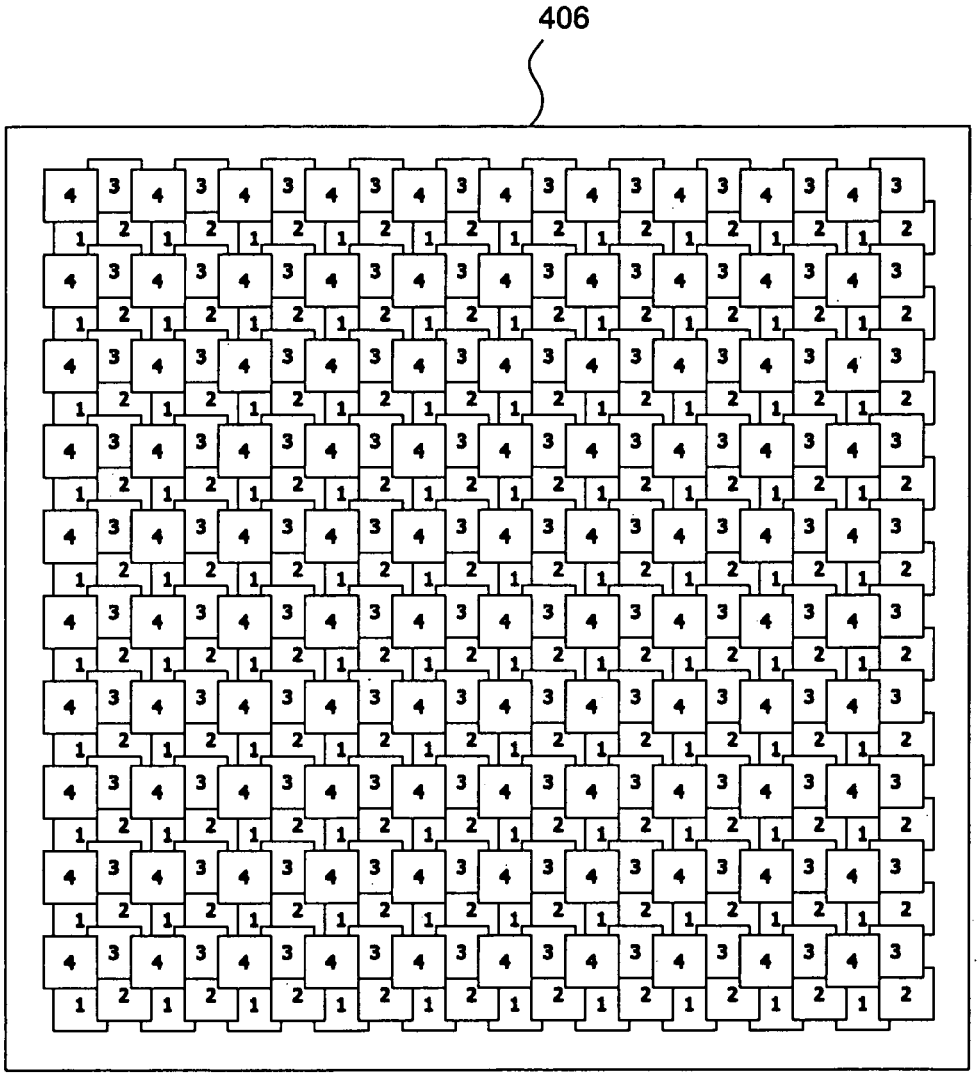
FIGS. 4C and 4D are front and perspective views, respectfully, of an MFA panel in an embodiment of the present invention that is based on four layers of square solid elements arranged relative to each other as shown in FIGS. 4A and 4B.
Figure 4D:
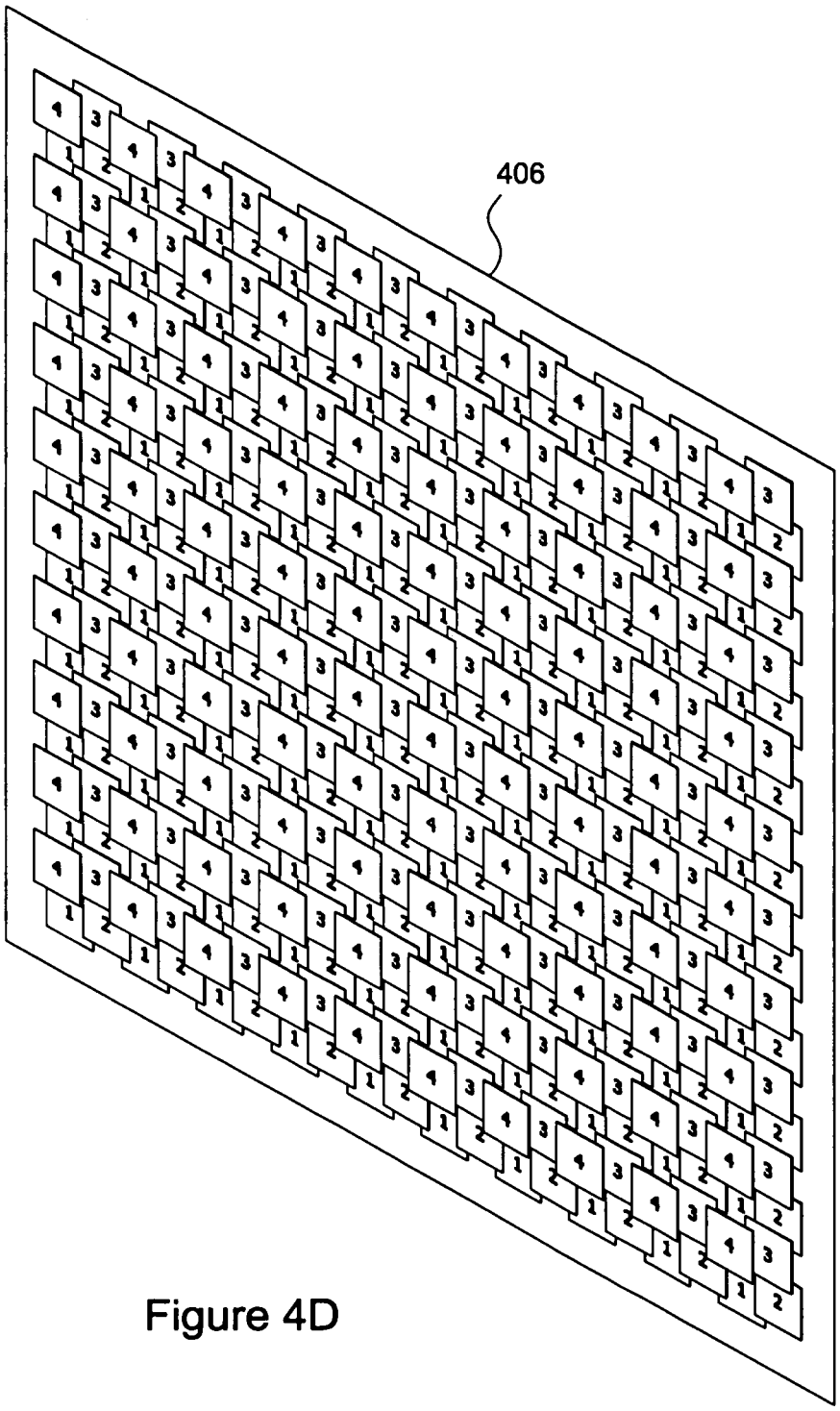

FIGS. 4A and 4B illustrate an arrangement of four rectangular solid elements, 401, 402, 403, and 404, whereby the element 404 numbered as "4" is attached to a supporting sheet (not shown) that is above the supporting sheet of the element 403 labeled as "3," which in turn is higher than the supporting sheet of the element 402 labeled as "2," with the supporting sheet of element 401 labeled as "1" being on the lowest level. This arrangement allows the four solid elements 401, 402, 403, 404 to overlap slightly without significant loss of compressibility. FIGS. 4C and 4D are front and perspective views respectively of a protective panel 406 constructed using the solid element arrangement of FIGS. 4A and 4B. Of course, when the panel 406 is compressed, the overlap of the solid elements 401, 402, 403, and 404 is temporarily increased.

The compressibility of the panels of the present invention cannot be measured using typical ASTM compression tests, such as ASTM D4032-08(2012) Standard Test Method for Stiffness of Fabric by the Circular Bend, because these standard test protocols measure only a very small area of a material, whereas it is necessary that the compressibility of the present invention be measured for the panel as a whole, which in embodiments is typically greater than 12 square inches in area. Therefore, the compressibility of embodiments of the present invention has been characterized using a special "vertical armor compression test."

Figure 5A:
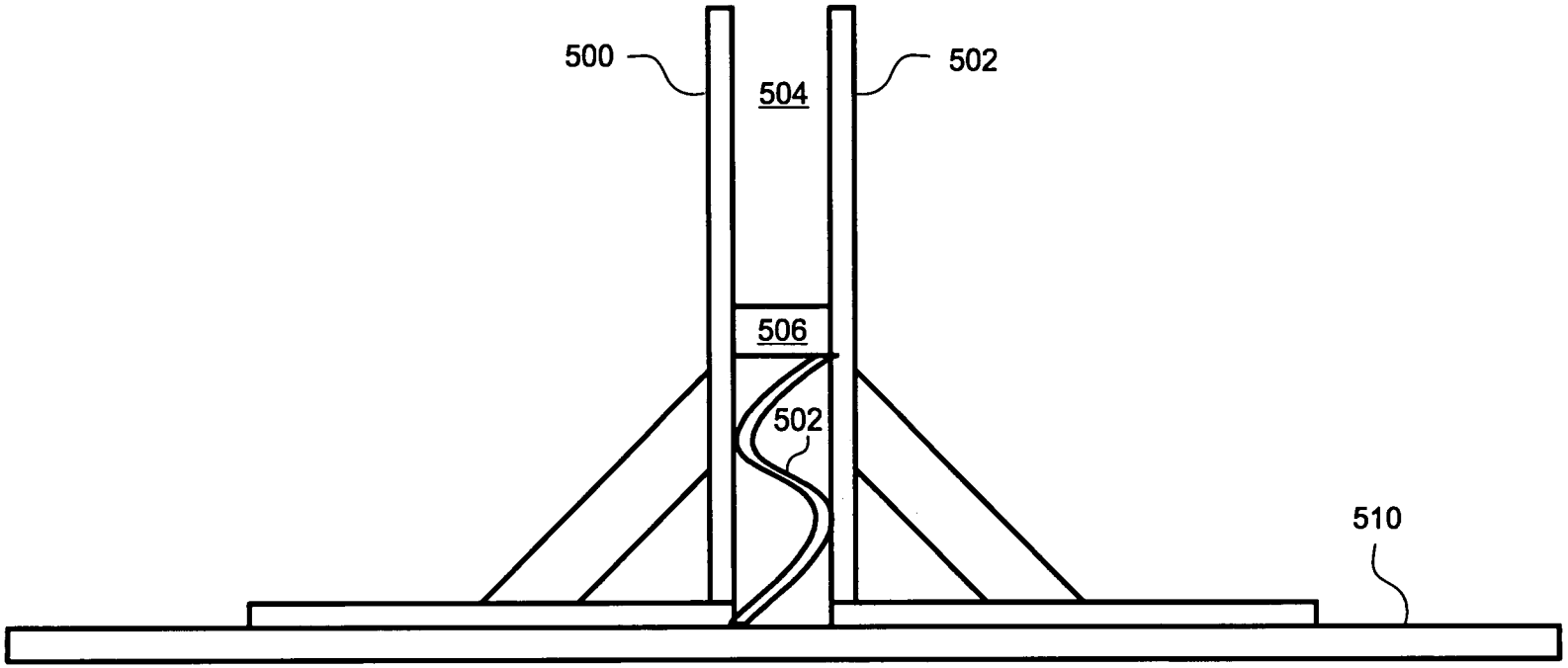
FIGS. 5A and 5B are side and perspective views, respectively, of an example of a vertical armor compression tester.
Figure 5B:
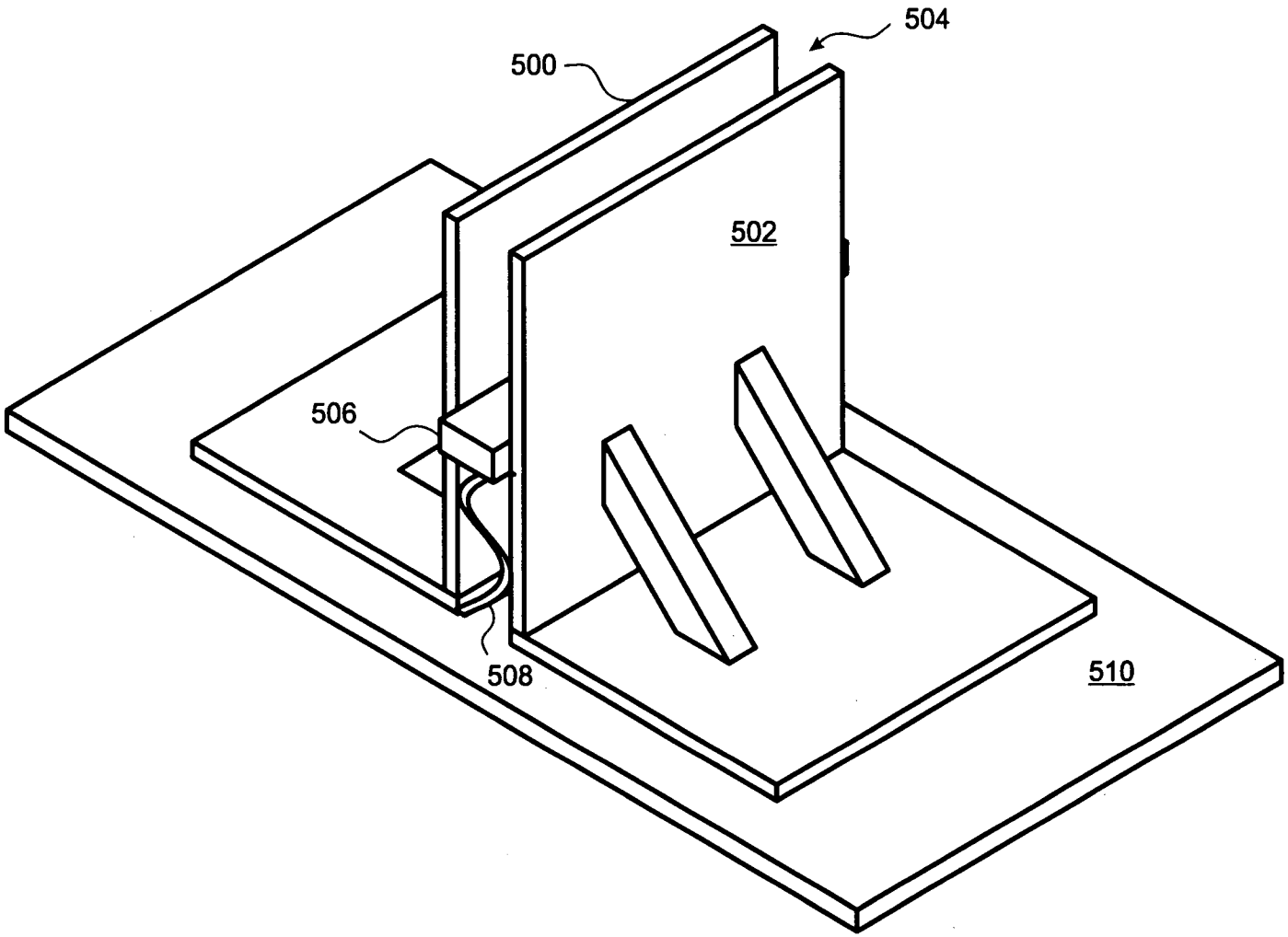

As shown in FIGS. 5A and 5B, the test apparatus that was used by the inventor to characterize the compressibility of the present invention consists of two vertical supports 500, 502 made of medium density fiberboard that are mounted on a horizontal surface 510 and spaced 75 mm apart. The panel 508 to be tested was dropped into the slot 504 formed between the two vertical supports 500, 502, and a 70 mm wide cross bar 506 was used to compress the panel into the slot. The cross bar mass was specified as 5 g/mm of panel width. For example, for a 400 mm wide panel 508 under test, the mass of the cross bar 506 was 2 kg.

For each embodiment that was tested, the armor panel 508 was placed in the gap 504 between the supports 500, 502 and allowed to slump under its own weight. The cross bar 506 was then placed on top of the panel 508. In each case, the operator was careful not to allow the armor panel 508 to become jammed between the cross bar 506 and the supports 500, 502, so that free compression under the cross bar load was measured. The height from the horizontal surface 510 to the bottom of the cross bar 506 was then measured at each end of the cross bar 506 and averaged. This height was then calculated as a percentage of the panel's protective, uncompressed width in the test direction.

For these measurements, the surrounding panel area that extended beyond the solid element area was not included in the compression calculation, because this region, being free of solid elements, does not provide any significant protection.

The armor panels were measured either wing-to-wing or neck-to-belt line. Although the MFA panels are sometimes used in combination with ballistic panels, the tests were performed with any such ballistic panels removed. However, all of the other sewing and layer-to-layer attachments were in place during the testing.

While the solid elements included in each of the individual layers that make up the panel of the present invention are generally spaced apart from each other, the layers when taken together substantially fill the area of the panel. In various embodiments, the solid elements more than fill the area of the panel, such that there is overlap of the solid elements from the different layers. The relatively small amount of overlap that is required even for protection against off-axis knife impact is an important, unexpected, and novel aspect of the invention. Before the invention was reduced to practice and tested, it was assumed that protection from off axis impacts would require an overlap approaching 50%, thereby effectively doubling the coverage density of the solid elements, and leading to a significant increase in mass and reduction in flexibility and compressibility.

Instead, by distributing the solid elements among a plurality of overlapping layers, the need for overlap is reduced in embodiments to between 3 and 5 mm. For example, in an embodiment wherein the solid elements are 25 mm squares and have an overlap of only 3 mm, which represents only 12% of the solid element width and 12% extra coverage of the solid elements, protection is provided for impacts up to 60 degrees off-axis, according to the VPAM specification. In this configuration, the gaps between solid elements on any given layer are 19 mm wide, thereby providing high compressibility and flexibility, which can be optimized still further by using supporting sheets made from fabrics having the lightest possible denier.

In another embodiment a P1 blade 45 degree impact was defeated according to the HOSDB level 2 knife requirement by a panel that includes 25 mm square solid elements that overlap by only 5 mm, resulting in only 18% of extra coverage. The gaps between the solid elements on each separate layer of this embodiment are 15 mm wide, and provide for good compression and flexibility.

In yet another embodiment, the NIJ spike level 3 requirement is satisfied by a panel that includes 25 mm square solid elements that overlap by 10 mm, or 37% of the solid element width. The resulting gaps between the solid elements on each separate layer are 5 mm wide, which is still sufficient to provide good flexibility and some compressibility.

In embodiments, the flexible supporting sheets are made of fibrous material. In some of these embodiments, the fibrous material is formed from a high modulus fiber of greater than 10 g/denier tenacity, which can provide enhanced performance. In other embodiments, the fibrous material is of less than 10 g/denier, such as nylon or polyester.

In some embodiments the supporting sheets of the invention are 4 g/d 150 denier PET (poly-ethylene terephthalate) woven layers of 50×50 epi ("ends per inch") construction. The approximately 3 oz/yd2 fabric in this embodiment is comparatively light weight and has good drape, which is of benefit to the compressibility and flexibility of the assembled panel. The tensile strength of the support fabric in this embodiment is approximately 60 lbf/inch. This is low enough that when the MFA stab assembly is used alone, i.e. not in combination with a ballistic panel, there could be a risk of tensile failure of the textile around the perimeter of the solid element at the point of stab impact.

In embodiments, this issue is addressed by including at least one layer of a high tensile strength textile as the back layer of the panel. For NIJ and HOSDB Level 1 and Level 2 stab impacts of nominally 35 joules, a single "backer" ply of 840 denier para aramid of 38×38 epi construction is adequate for preventing tensile failure due to stab impact. This approach is significant, because it allows the use of light denier PET, Nylon and/or cotton fabrics and their blends as the supporting sheets for the solid elements. The use of light fabrics below 500 d significantly improves the compressibility and flexibility of the assembly. In some of these embodiments the backer ply supports the rear-most layer of solid elements, while in other of these embodiments the backer ply is separate from the solid element supporting sheets.

Yet another embodiment uses supporting sheets made from a 400 denier para-aramid yarn of 23 g/d with a 36×36 epi construction as the supporting sheets for the solid elements. These supporting sheets are somewhat heavier (approximately 3.5 oz/yd2) than the PET material described above, but have the benefit of improved performance when the MFA panel is used in combination with a ballistic panel.

The adhesive system that attaches the solid elements to the backer fabric is critical to the performance and durability of the system. As in the case of all adhesively assembled MFA systems, the quality of the adhesive bond between the textile supporting sheets and the solid elements must be durable enough to support a typical 5-8 year armor life.

In some embodiments a thermoplastic polyether urethane is used as the adhesive between PET supporting sheets and steel solid elements. When suitable primers are applied to the PET and steel, this adhesive system provides a bond of approximately 100 lbf per inch of lap shear strength. In some of these embodiments the adhesive is only applied to the textile area under and directly adjacent to the edges of the solid elements, while no adhesive is applied in the gaps between the solid elements. This is significant, because the compressibility and flexibility is provided by the gaps between the solid elements in each layer, and so the introduction of adhesives and coatings into those gaps would reduce the compressive performance of the panel by as much as 10-15%.

In other embodiments, the adhesive system is a sulfur cure chloroprene elastomer. In these embodiments the adhesive is applied as a solvent cement to the fabric and to the solid elements. The adhesive is located between the fabric and the solid elements and around and over the edges of the solid elements, creating a feathered elastomeric transition from the top of the solid element to the uncoated surface of the fabric. This feathering of the edges is useful because it prevents snagging of the solid element edges and corners on the other fabric layers in the panel, which can cause damage to the bond-line, and can affect the durability of the product.

In embodiments, the solid elements are supported by supporting sheets of para-aramid material. In some embodiments, the supporting sheets are attached to each other only at their edges, which allows the inner layers of the panel to have a substantially complete range of motion when compressed or flexed.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications without departing from the spirit thereof. The disclosure presented herein does not explicitly disclose all possible combinations of features that fall within the scope of the invention. The features disclosed herein for the various embodiments can generally be interchanged and combined into any combinations that are not self-contradictory without departing from the scope of the invention. In particular, the limitations presented in dependent claims below can be combined with their corresponding independent claims in any number and in any order without departing from the scope of this disclosure, unless the dependent claims are logically incompatible with each other.

I claim:

1. A flexible and compressible armor panel suitable for constructing wearable multi-threat protection, the panel comprising:

a plurality of flexible fabric supporting sheets arranged in a vertical stack to form a panel; and a plurality of unitary, rigid solid elements distributed among and adhered by an adhesive to the supporting sheets, said solid elements being horizontally spaced apart on the individual supporting sheets, but arranged in the stack in a vertically offset but horizontally adjacent or overlapping relationship that covers substantially all of a protective region of the panel, the supporting sheets being attached to one another only about their edges, thereby allowing portions of the supporting sheets to move horizontally relative to each other; and for each of the supporting sheets, said solid elements on said supporting sheet being slidable over each other so as to allow compression of the panel.

2. The armor panel of claim 1, wherein the solid elements include metal.

3. The armor panel of claim 2, wherein the metal is steel.

4. The armor panel of claim 1, wherein at least one of the supporting sheets includes para-aramid fibers.

5. The armor panel of claim 4, wherein the para-aramid fibers staple fibers.

6. The armor panel of claim 1, wherein at least one of the supporting sheets includes a yarn having an average tenacity of less than 10 gpd.

7. The armor panel of claim 6, wherein the supporting sheet is a woven fabric sheet.

8. The armor panel of claim 1, wherein the solid elements are triangular, and are arranged when overlaid in a horizontally adjacent, hexagonal configuration.

9. The armor panel of claim 8, wherein the solid elements are distributed in pairs among three of the supporting sheets, the pairs being directly opposed to each other and touching at only one central vertex.

10. The armor panel of claim 1, wherein the solid elements are square, and are arranged when overlaid in a square, horizontally overlapping configuration.

11. The armor panel of claim 1, wherein at least some pairs of horizontally adjacent or overlapping solid elements are vertically separated from each other by more than one layer of the stack of supporting sheets.

12. The armor panel of claim 1, wherein the solid elements adhered to at least one of the individual supporting sheets are horizontally spaced apart from each other by a distance that is at least 10% of a smallest side dimension of the solid elements.

13. The armor panel of claim 1, wherein the armor panel provides protection against specified maximum ballistic, blade, and spike threats.

14. The armor panel of claim 1, wherein the armor panel is compressed by an amount equal to at least 25% of its effective width when tested by means of a vertical armor compression test.

15. The armor panel of claim 1, further comprising adhesive applied around and over edges of the solid elements attached to at least one of the supporting sheets, said adhesive creating a feathered elastomeric transition from a top of the solid element to an uncoated surface of the supporting sheet.

16. The armor panel of claim 1, wherein the supporting sheets contain yarn of tenacity of less than 10 g/denier.

17. The armor panel of claim 1, wherein the supporting sheets include at least one of nylon, polyester, PET, and cotton.

18. The armor panel of claim 1, further comprising a para aramid backer ply applied to a rear surface of the stack of the panel.

19. The armor panel of claim 18, wherein the para aramid backer ply is made from yarn with tenacity greater than 10 gpd and denier per inch greater than 15,000.

20. The armor panel of claim 1, wherein the adhesive provides a bond of approximately 100 lbf per inch of lap shear strength.

21. The armor panel of claim 1, wherein the adhesive is a sulfur cure chloroprene elastomer.

* * * * *